US005438810A

United States Patent [19]

Bullen et al.

[11] Patent Number: 5,438,810

[45] Date of Patent: Aug. 8, 1995

[54] ROOFING PANELS AND ROOFING ASSEMBLIES THEREOF

[76] Inventors: Robert J. Bullen, "Lauren", South Lane, Ash, Surrey GU12 6NG; Gordon D. Addison, 33 Ombesley Road, Worcester W93 7BP, both of England

[21] Appl. No.: 182,607

[22] Filed: Jan. 14, 1994

[30] Foreign Application Priority Data

Jan. 16, 1993 [GB] United Kingdom ..... 9300792

[51] Int. Cl.[6] ..... E04D 1/36

[52] U.S. Cl. ..... 52/539; 52/533; 52/542; 52/543

[58] Field of Search ..... 52/519, 539, 542, 543, 52/529, 530, 588.1, 532, 533, 534

[56] References Cited

U.S. PATENT DOCUMENTS

| | | | |
|---|---|---|---|
| 1,091,049 | 3/1914 | Edwards | 52/529 |
| 4,054,012 | 10/1977 | Paradisi et al. | 52/545 X |
| 4,308,702 | 1/1982 | Rajewski | 52/519 |
| 4,715,157 | 12/1987 | Funaki | 52/529 |
| 4,759,165 | 7/1988 | Getoor et al. | 52/539 |
| 4,926,608 | 5/1990 | Beauregard | 52/542 X |

FOREIGN PATENT DOCUMENTS

| | | |
|---|---|---|
| 0210817 | 2/1987 | European Pat. Off. . |
| 1562892 | 2/1978 | United Kingdom . |
| 2267718 | 12/1993 | United Kingdom . |

*Primary Examiner*—Carl D. Friedman
*Assistant Examiner*—Kien T. Nguyen

[57] ABSTRACT

A roofing panel for use on inclined roofing support structures wherein the panel is formed of sheet material and is configured in section from its higher to its lower end such as to define at its upper end a downwardly depending foot arranged in use to enable securement to the roof support structure at or adjacent its higher end and then an upwardly extending ridge lower than the foot and having in its side facing the lower end of the panel, a slot; the lower end of the panel including a downwardly directed ridge arranged in use to overly the ridge of the next succeeding lower panel and including a tongue directed towards the higher end of the panel and lying beneath the under surface of the panel and arranged in use to engage with the slot in the upwardly directed ridge of the next succeeding lower panel for positive location therewithin, whereby the panel in use lies over the downward depending securement foot of the next succeeding lower panel.

12 Claims, 4 Drawing Sheets

ROOFING PANELS AND ROOFING ASSEMBLIES THEREOF

BACKGROUND OF THE INVENTION

This invention relates to roofing panels and roofing assemblies thereof.

It has been proposed to provide roofing panels and assemblies thereof to be used on underlying inclined roofing supports for domestic and office and industrial purposes formed from sheet material of a light weight nature compared to traditional tile and slate roof coverings.

Problems associated with such roofing panels and roof structures made therefrom include problems of ensuring the panels remain in position on their supports during adverse wind conditions for example, and leakage and corrosion problems caused especially at and adjacent the locations of fixing the panels on the underlying roofing supports.

It is an object of the present invention to overcome or at least substantially reduce the above-mentioned problems.

SUMMARY OF THE INVENTION

In accordance with the invention there is provided a roofing panel for use on inclined roofing support structures. The roofing panel includes a panel member formed of sheet material and configured to define at a higher end a downwardly depending foot arranged in use to enable securement of the panel member to the roofing support structures at or adjacent the higher end. Between the higher end and a lower end of the panel member is an upwardly extending ridge having a slot in a side of the ridge facing the lower end of the panel member. The upwardly extending ridge projects a transverse distance from a main body of the panel member which is less than a transverse distance which the foot projects from the main body of the panel member. The lower end of the panel member includes a downwardly directed ridge arranged in use to overly an upwardly extending ridge of a next succeeding lower panel member. The lower end includes a tongue directed towards the higher end of the panel member and lying beneath an under surface of the panel member and arranged in use to engage with a slot in the upwardly directed ridge of the next succeeding lower panel member for positive location therewith, whereby the panel member in use lies over a downwardly depending securement foot of a next succeeding lower panel member.

It is to be understood that the use of the expressions "higher" "lower" in relation to panels refers respectively to those ends of the panels which, when in use and mounted on an inclined roofing support arrangement are disposed at a higher level and a lower level with respect to that inclined support arrangement. Again the expressions "over" and "under" refer to the surfaces the main portions of each panel which, when in position on a roofing support structure are directed generally upwards and downwards respectively. Yet again the expressions "upwardly directed" and "downwardly directed" in relation to portions of the panel refer to portions which, when the panel is in position on a roofing support structure protrude upwardly and downwardly respectively.

The panel is preferably of generally uniform cross-section across its width.

The panel may be formed of metal sheeting, plastic sheeting, or sheeting of mineral substances, for example and may be provided with a protective coating of known kinds and colours and may be formed by rolling or pressing or extrusion. The panel may include insulation materials bonded to or attached to or associated with the under surface thereof.

The panel may be in the form of an elongate member arranged in use to extend across substantial widths of the roofing structure concerned, and, by virtue of the configuration of its construction from its upper end to its lower end, may be self-supporting over substantial spans between rafters or trusses of the roof support structure.

The tongue of the downwardly directed ridge at the lower end of the panel may be arranged to be snap engageable with the slot of the upwardly directed ridge adjacent the upper end of the next succeeding lower panel.

The tongue and/or the slot may include grooves across the width of the panel for the transmission of water of condensation or rainfall nature therealong, and to prevent capillary effect passage of water between the interengaging portions of the tongue and slot to the space beneath the panels.

The invention includes within its scope a roofing assembly incorporating a plurality of panels as hereinbefore defined attached to inclined roofing supports.

The roofing assembly may include at least one overlay panel comprising in section from its upper end to its lower end a tongue at its upper end arranged in use to engage in the slot of an upper underlying panel in accordance with the invention, and at its lower end including a downwardly directed ridge arranged in use to overly the upwardly extending ridge of the next succeeding lower panel according to the invention and including a tongue directed towards the higher end of the panel and lying beneath the under surface of the overlay panel and arranged in use to engage with the slot in the upwardly directed ridge of the next succeeding lower panel for positive location therewithin.

BRIEF DESCRIPTION OF THE DRAWINGS

In order that the invention may be more readily understood a number of embodiments thereof will now be described by way of example with reference to the accompanying drawings in which.

DETAILED DESCRIPTION OF THE PREFERRED EMBODIMENT

Figure 1:
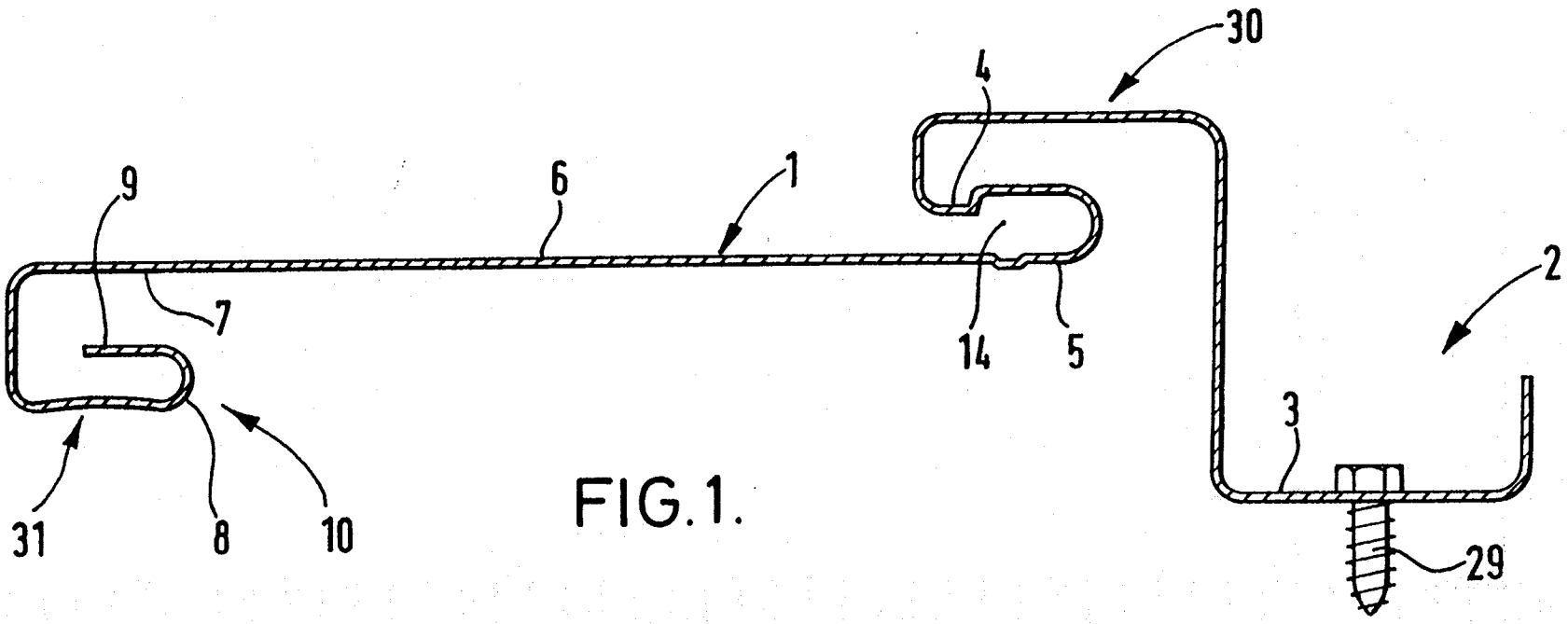
FIG. 1 is a sectional elevation through a roofing panel in accordance with the invention.
Figure 2:
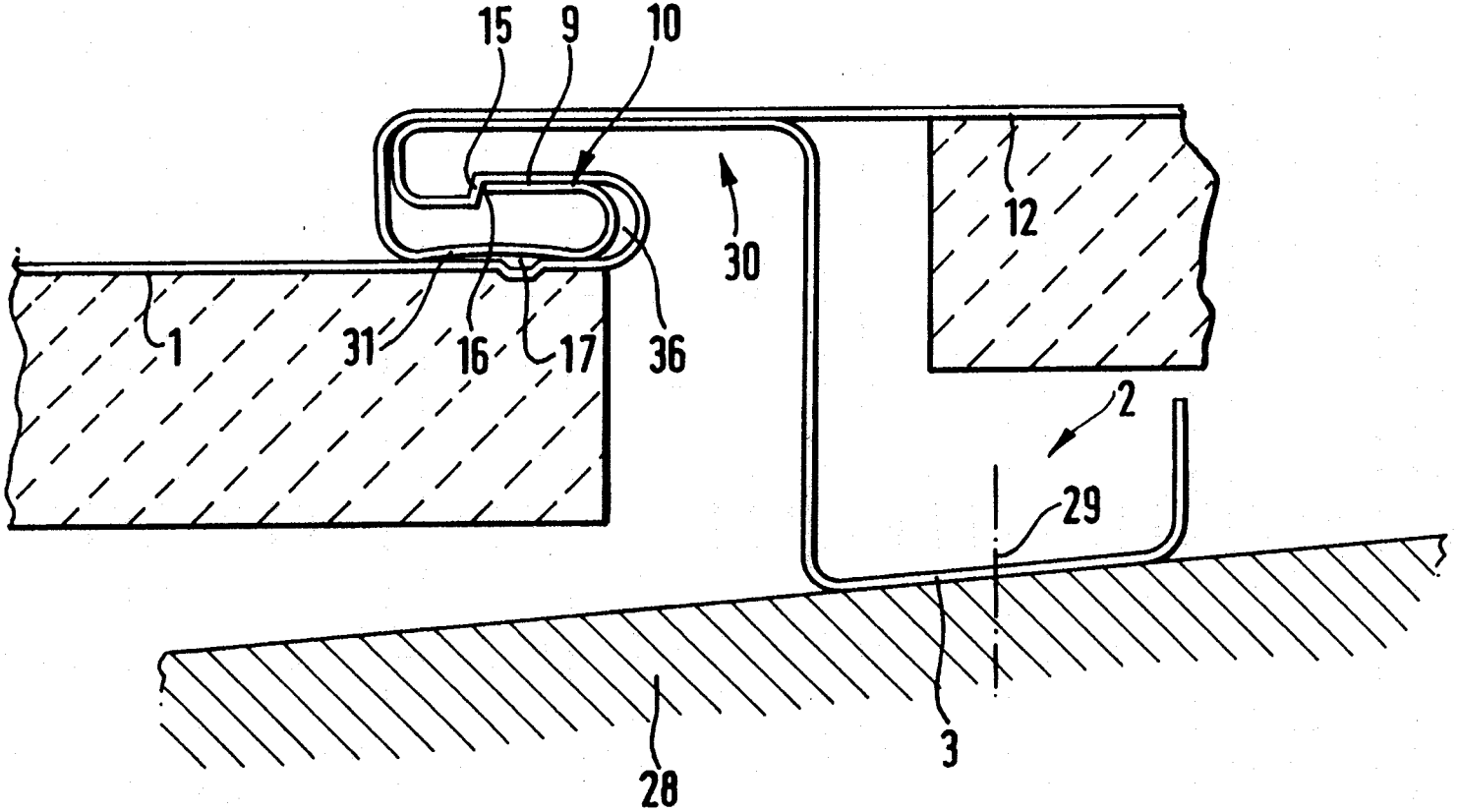
FIG. 2 is a sectional elevation of part of two panels of the kind shown in FIG. 1 connected together.
Figure 3:
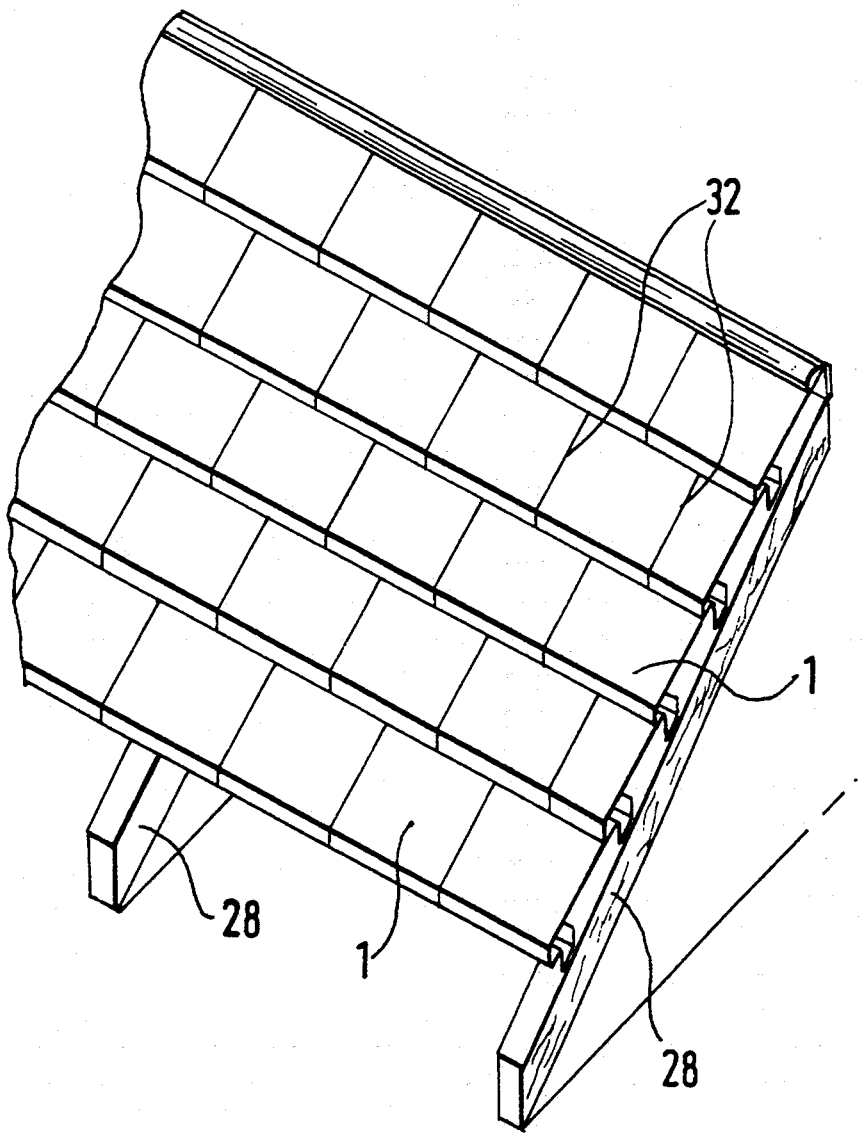
FIG. 3 shows a roofing assembly including a plurality of panels of the kind shown in FIGS. 1 and 2.

FIGS. 1 to 3 illustrate a roofing panel, and a roofing assembly formed, therefrom in accordance with the invention having dimensions intended to give the visual appearance of a tiled roof.

Each panel 1 is elongate in its width and extends across a roof support arrangement comprising a plurality of rafters 28 or trusses inclined to the horizontal, transverse to the elongate length of the panel.

In section the panel 1 comprises, reading from its higher end, a downwardly depending channel 2 running across the width of the panel including a batten foot 3 by means of which the panel may be secured to a roof rafter by screws 29 for example; an upwardly directed ridge 30 of generally rectangular configuration and having a slot 14 on its lower side defined by a first re-entrant surface 4 generally parallel to the overall plane of the tile panel, turning through 180° with a second surface 5 merging, from the upper end of the panel, with the main body 6 the panel itself to the lower end thereof. The slot extends across the width of the panel adjacent the higher end thereof at a level generally of that of the panel over surface. The upwardly directed ridge 30 projects a transverse distance from the main body 6 of the panel which is less than a transverse distance which the batten foot 3 projects from the main body 6 of the panel.

At the lower end of the panel 1 a downwardly directed ridge 31 turns to lie under the under surface 7 of the panel and is directed towards the higher end thereof, and this ridge 31 in turn merges via a curved portion 8, with a re-entrant portion 9 of the panel directed again to the lower end thereof to define a tongue 10. The turned ridge 31 of the panel and the re-entrant portion 9 at the lower end lying beneath the panel are so arranged and configured as to be capable of engagement in the slot 14 at the higher end of another panel 12.

Such an arrangement can be seen in FIG. 2 which shows the connection between the two panels 1 and 12 in greater detail.

As can be seen the channel 2 at the higher end of one panel 1 acts as a batten foot adapted for the reception of a screw (not shown) for connection of the panel 1 to a rafter 28 or similar roofing support member. The slot 14 of the higher end of panel 1 receives the reversed direction and re-entrant portions 31, 9 of a higher panel 12 comprising tongue 10, the configuration of these portions being such that the fixing between them is on a snapfit basis. It is to be noted that the slot 14 of the higher end of the panel 1 includes a retainer shoulder 15 abutting against the end 16 of the re-entrant portion 9 of the tongue 10 of panel 12. In addition by means of a channel 17, and spacing 36 arranged between the tongue and slot of the two panels, sufficient separation between the panels is ensured to break any potential capillary path for moisture to travel from on top of the panels 1, 12 into the volume beneath them.

In assembly, a succession of panels, commencing from the lowest one, will be assembled one into the next to produce a structure as shown in FIG. 3.

FIG. 2 also shows an optional insulation material 50 which is bonded or attached to or associated with the under surface 7 of a main body 6 of the panel using conventional techniques. While the insulation material is shown attached to the panel between the foot and the tongue, this placement may be varied to suit particular design considerations.

The arrangement of FIGS. 1, 2 and 3 essentially can have dimensions such as to resemble closely in appearance a tile roofing, each elongate panel 1 being provided with a crosswise groove 32 periodically along its length with alternate rows offset from each other to emphasise the pattern.

Figure 4:
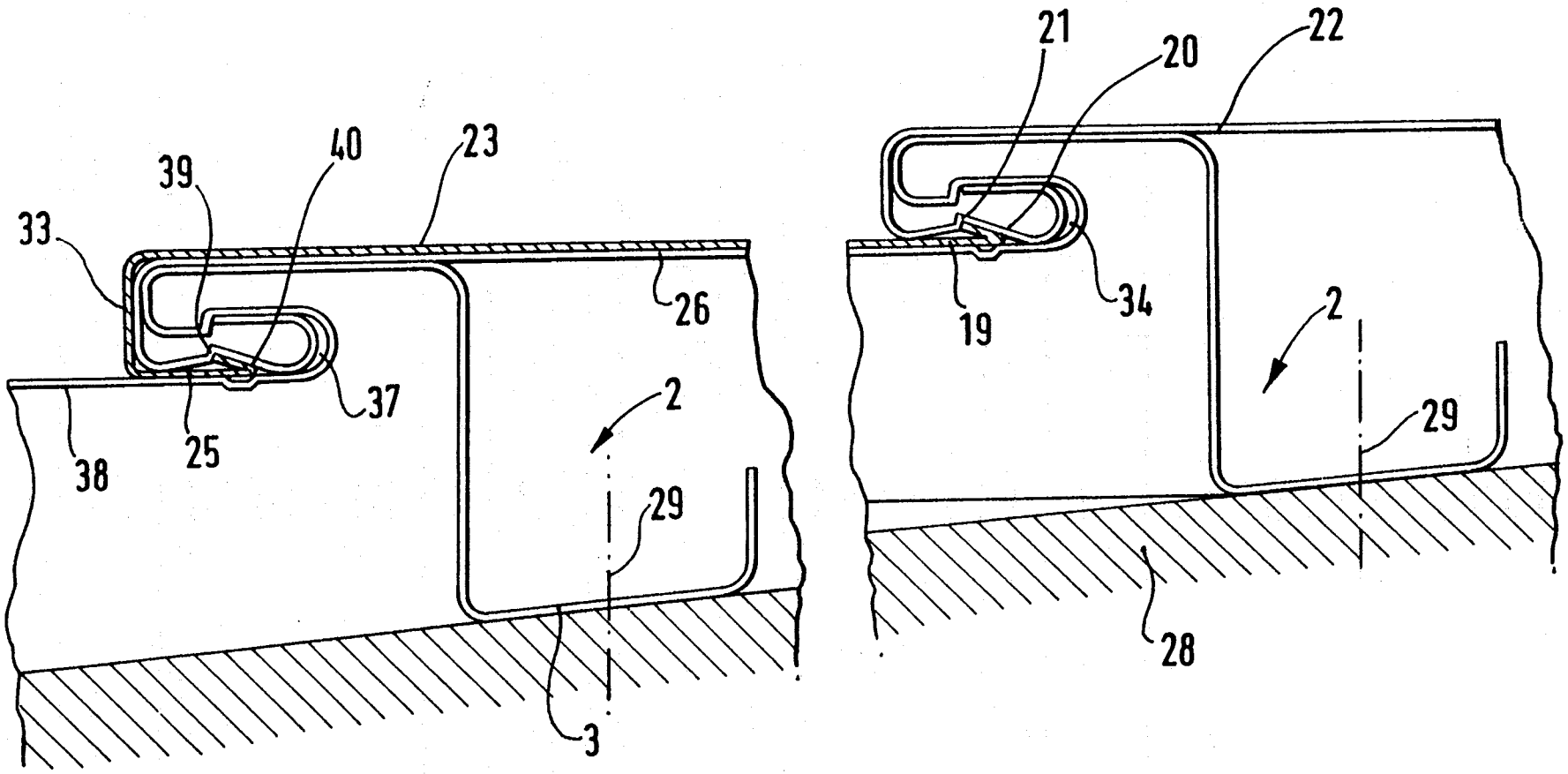
FIG. 4 is a side elevational section showing the fitment of an overlay panel in a similar arrangement to that of FIG. 2.

FIG. 4 illustrates another embodiment of the present invention, wherein, an overlay panel 23 is used either to rectify damage on one or more panels according to the invention, or to provide a colour change of one or more panels. As can be seen the overlay panel 23 comprises at its higher and a tongue or flange 19 extending across the width thereof arranged in use to abut behind a shoulder 21 on the reverse portion 20 of the end tongue of a higher panel 22 according to the invention when disposed in slot 34 of a lower panel 26 according to the invention. The lower end 33 of overlay panel 23 is bent over downwardly and then provided with a reverse direction portion 25 so that it can also be snap fitted into the slot 37 of a lowermost panel 38 according to the invention, again engaging with a shoulder 39 of the tongue portion 40 of the upper panel 26. It will be appreciated therefore that the overlay panel 23 is positively located at each end in an upper to lower direction behind a shoulder 39,21 on the tongues 40,20 of the relevant panels 26,22, respectively.

Figure 5:
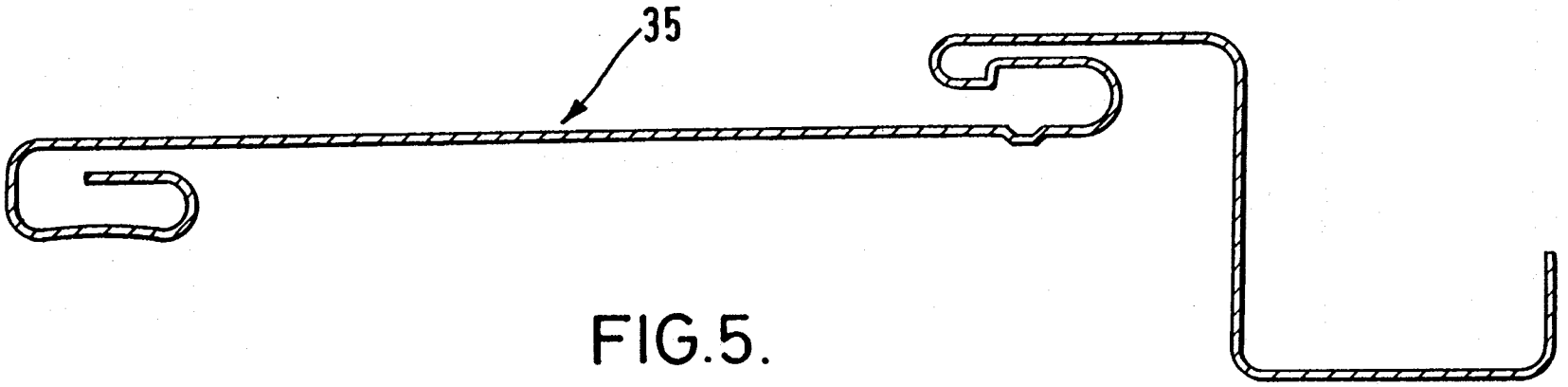
FIG. 5 shows another form of panel according to the invention of different dimensions.

The arrangement shown in FIG. 5 is of a panel 35 which is a different embodiment of the invention. Here the vertical dimensions of the fixing portions at the higher and lower ends of each panel are reduced and the panel length increased so that the effect of the roofing assembly formed thereby is of slate roofing, as distinct from a tile roofing.

By means of the invention we have provided a roofing panel and a roofing structure incorporating a plurality of such panels which, because of the interlocking spring connection, with the integral batten foot arrangement at the higher ends of the panels, are self supporting over long spans between main purlins or rafters.

In particular it is to be noted that the interlocking and spring interconnection between panels provides strong resistance against uplifting tendencies from strong winds.

It is also to be noted that there are no exposed through fixings from over surface of the panel roofing assembly to the underlying purlins or rafters, since each higher panel lies over the securement batten foot of the next lower panel.

It will be appreciated that variations in dimensions of length and width and height of the higher and lower ridges enable the roofing panels and roofing assemblies incorporating the same to simulate many types of tile or slate structures and to accommodate considerable variation in length of building.

The panels may be made formed by rolling, pressing, or extrusion from various types of metals plastics and mineral substances, and may be provided with appropriate coatings and colours. The coatings may be of various materials colours and finishings.

Overall a very effective and lightweight roofing structure is provided.

It is to be understood that the foregoing is merely exemplary of roofing panels and roofing structures made therefrom in accordance with the invention and that modifications can readily be made thereto without departing from the true scope of the invention. Thus, for example, integral multiple panels can be used, having a dimension from higher to lower end corresponding to a plurality of single panels, and having a sectional configuration from upper to lower end conforming to the plurality of assembled single panels and with a downwardly depending foot for securement and a slotted upwardly extending ridge at its upper end, and a downwardly directed ridge and associated tongue at its lower end.

What is claimed is:

1. A roofing panel for use on an inclined roofing support structures, the roofing panel comprising: a panel member formed of sheet material and configured in section from a higher end thereof to a lower end thereof such as to define at the higher end thereof a downwardly depending foot arranged in use to enable securement of the panel member to the roofing support structures at or adjacent the higher end and then an upwardly extending ridge having a slot in a side of the ridge facing the lower end of the panel member, wherein the upwardly extending ridge projects a transverse distance from a main body of the panel member which is less than a transverse distance which the foot projects from the main body of the panel member; the lower end of the panel member including a downwardly directed ridge arranged in use to overly an upwardly extending ridge of a next succeeding lower panel member and the lower end including a tongue directed towards the higher end of the panel member and lying beneath an under surface of the panel member and arranged in use to engage with a slot in the upwardly directed ridge of the next succeeding lower panel member for positive location therewithin, whereby the panel member in use lies over a downward depending securement foot of a next succeeding lower panel member.

2. A roofing panel as claimed in claim 1 of generally uniform cross section across a width of the panel member.

3. A roofing panel as claimed in claim 1 formed of metal sheeting provided with a protective coating.

4. A roofing panel as claimed in claim 1 wherein the panel member includes insulation materials bonded to or attached to the under surface thereof.

5. A roofing panel as claimed in claim 1 wherein the panel member is an elongate member arranged in use to extend across substantial widths of the roofing structure and, wherein the higher end and the lower end self-support the elongate member over substantial stands between rafters or trusses of the roofing structure.

6. A roofing panel as claimed in claim 1 wherein the tongue of the downwardly directed ridge at the lower end of the panel is arranged to be snap engagable with a slot of the upwardly directed ridge adjacent the higher end of the next succeeding lower panel member.

7. A roofing panel as claimed in claim 6 wherein at least one of the tongue and slot include a groove across the width of the panel member for the transmission of water or condensation or rainfall nature therealong, and to prevent capillary effect passage of water between an end of the tongue and the slot to a space between adjacent panel members.

8. A roofing assembly comprising a plurality of roofing panels wherein each roofing panel is attached to inclined roofing supports and wherein each roofing panel comprises:

a main body having a higher end and a lower end;

the higher end having a downwardly depending foot secured to the roofing supports, and an upwardly extending ridge having a slot therein facing the lower end of the roofing panel, wherein the upwardly extending ridge projects a transverse distance from the main body of the roofing panel which is less than a transverse distance which the foot projects from the main body of the roofing panel;

the lower end having a downwardly directed ridge overlying an upwardly extending ridge of a next succeeding lower roofing panel, and a tongue directed towards the higher end of the roofing panel and lying beneath an under surface of the roofing panel and engaged to engage with a slot in the upwardly directed ridge of the next succeeding lower roofing panel for positive location therewith, whereby the roofing panel in use lies over a downward depending securement foot of the next succeeding lower roofing panel.

9. The roofing assembly of claim 8, further comprising at least one overlay panel, each overlay panel including:

a higher end having a tongue engaged in the slot of a next succeeding higher roofing panel; and a lower end having a downwardly directed ridge which overlies the upwardly extending ridge of the next succeeding lower roofing panel, and a tongue directed towards the higher end of the roofing panel and lying beneath an under surface of the overlay panel and engaged with the slot of the upwardly directed ridge of the next succeeding lower roofing panel.

10. The roofing assembly of claim 9, wherein the tongue of the higher end of the overlay panel extends upward engaging a corresponding shoulder recess in the tongue of the lower end of the next succeeding higher roofing panel.

11. The roofing panel of claim 9, wherein the tongue of the lower end of the overlay panel extends upward engaging a corresponding shoulder recess in the tongue of the higher end of the next succeeding lower roofing panel.

12. A roofing panel for use on a roofing support structure, the roofing panel comprising:

a main body having a higher end and a lower end;

the higher end having a downwardly depending foot for use in securing the roofing panel to the roofing support structure, and an upwardly extending ridge having a slot therein facing the lower end of the roofing panel, wherein the upwardly extending ridge projects a transverse distance from the main body of the roofing panel which is less than a transverse distance which the foot projects from the main body of the roofing panel;

the lower end having a downwardly directed ridge overlying an upwardly extending ridge of a next succeeding lower roofing panel, and a tongue directed towards the higher end of the roofing panel and lying beneath an under surface of the roofing panel for engaging a slot in the upwardly directed ridge of the next succeeding lower roofing panel for positive location therewith, whereby the roofing panel in use lies over a downward depending securement foot of the next succeeding lower roofing panel.

* * * * *

UNITED STATES PATENT AND TRADEMARK OFFICE

CERTIFICATE OF CORRECTION

PATENT NO. : 5,438,810

DATED : August 8, 1995

INVENTOR(S) : ROBERT J. BULLEN, GORDON D. ADDISON

It is certified that error appears in the above-indentified patent and that said Letters Patent is hereby corrected as shown below:

Col. 4, line 18, delete "an upper", and insert --a higher--

Col. 6, line 11, delete "to engage"

Signed and Sealed this

Seventeenth Day of October, 1995

*Attest:*

Bruce Lehman

BRUCE LEHMAN

*Attesting Officer*

*Commissioner of Patents and Trademarks*